United States Patent [19]

Van Vreeswyk

[11] Patent Number: 4,458,761

[45] Date of Patent: Jul. 10, 1984

[54] UNDERREAMER WITH ADJUSTABLE ARM EXTENSION

[75] Inventor: Adolf W. Van Vreeswyk, Lakewood, Calif.

[73] Assignee: Smith International, Inc., Newport Beach, Calif.

[21] Appl. No.: 416,273

[22] Filed: Sep. 9, 1982

[51] Int. Cl.[3] ..... E21B 10/32

[52] U.S. Cl. ..... 166/289; 166/286; 166/269; 74/526

[58] Field of Search ..... 175/286, 289, 287, 284, 175/267, 268, 269, 384, 258; 74/526, 565; 403/116, 113, 117

[56] References Cited

U.S. PATENT DOCUMENTS

| | | | |
|---|---|---|---|
| Re. 19,281 | 8/1934 | Schroeder | 175/273 |
| 402,394 | 4/1889 | Brown | 175/384 |
| 1,500,001 | 7/1924 | Rogers | 175/384 |
| 2,485,826 | 10/1949 | Harinck | 175/286 |
| 2,699,921 | 1/1955 | Garrison | 175/267 |
| 3,171,503 | 3/1965 | Shirley | 175/269 |
| 3,750,771 | 8/1973 | Cugini | 175/269 |
| 3,894,590 | 7/1975 | Takano et al. | 175/269 |
| 4,282,941 | 8/1981 | Perkin | 175/267 |
| 4,337,764 | 6/1982 | Lerman | 403/116 |

*Primary Examiner*—James A. Leppink
*Assistant Examiner*—Hoang C. Dang
*Attorney, Agent, or Firm*—Christie, Parker & Hale

[57] ABSTRACT

An underreamer having an adjustable arm extension includes a cam for urging the arm outwardly in an opened position, and a stop pin which engages a slot in the arm for limiting the maximum arm extension. An insert for the arm has a surface which overlaps a portion of the slot to establish an effective length for the slot. By changing the configuration of the surface on the insert, the arm extension can be adjusted.

11 Claims, 2 Drawing Figures

UNDERREAMER WITH ADJUSTABLE ARM EXTENSION

FIELD OF THE INVENTION

This invention pertains to underreamers and provides an underreamer having an adjustable arm extension.

BACKGROUND OF THE INVENTION

Underreamers are tools used for enlarging the gage of a hole drilled into the earth such as an oil or gas well. A typical underreamer has a tubular body which can be connected to a drill string. One or more cutting arms are housed in the tubular body as the underreamer is lowered through a borehole. When the region to be underreamed to a larger diameter is reached, the cutter arms are deployed outwardly away from the body to engage the gage of the drill hole. Hard cutting surfaces carried on the cutting arms engage the rock formation and crush it away as the underreamer is turned by the drill string. A variety of cutters can be mounted on the arms.

It is desirable to establish boreholes having different diameters for different purposes. It is accepted practice to drill an initial hole with standardized drilling equipment and later ream out the hole under a restriction to the desired gage with underreamers.

The diameter of an underreamed hole is established by limiting the outward movement of the cutting arms from the underreamer body. Each cutting arm has a particular size and opening diameter. Previously, every time the reaming gage was changed, one replaced the cutting arms from the underreamer with a new set of arms having the desired extension. This approach is time consuming and requires a large inventory of cutting arms.

It would be desirable to provide an underreamer which has a readily adjustable cutting arm extension.

One underreamer arrangement is disclosed in U.S. Pat. No. 4,282,941, issued Aug. 11, 1981, to Perkin. In this underreamer, each cutter support arm is urged outwardly from a fully retracted position essentially within the underreamer body to an opened position where a cam follower surface 55 engaged with a cam 49 are essentially parallel to the underreamer axis. The cam configuration provides only one opened position for the arm. Further outward movement of the arm is prevented by a stop plate 83 carried on the body which engages a stop projection 84 on the cutting arm. If it is desired to alter the expanded size of the Perkin underreamer, the stop plate 83 can be replaced by a stop plate having a different finger stop configuration so that the stop projections 84 will engage the radially inner faces of the stop plate fingers closer to or further from the underreamer axis. However, according to Perkin at col. 10, lines 19–27, it is also necessary to replace the entire cutter support arm by an arm having a different cam follower surface configuration.

It would be desirable to provide an underreamer where the amount of arm extension or its opening diameter can be adjusted without having to replace the entire arm or the configuration of the underreamer's arm actuating mechanism.

SUMMARY OF THE INVENTION

There is, therefore, provided in practice of this invention in a presently preferred embodiment, an underreamer having an adjustable arm extension which does not require replacement of a cutting arm for adjusting the arm extension.

An underreamer according to this invention comprises a tubular body and means for connecting an upper end of the tubular body to a drill string. A cutting arm is hingedly connected to the body for movement between a fully retracted position essentially within the tubular body, and an opened position in which an outer end of the arm is disposed outwardly from the body. Means are provided for camming the arm from the retracted position toward an over-opened position. Means are also provided for stopping the outward movement of the arm at the opened position which is between the retracted and the over-opened positions. Preferably the stopping means comprises a stop pin in the body for cooperative engagement with a slot in the arm for limiting the maximum outward travel of the arm to the opened position. The stopping means also comprises a removable plate on the arm. The plate has a surface which is engageable with the stop pin. The surface overlaps at least part of the slot for adjusting the effective length of the slot whereby the maximum outward travel of the arm at the opened position can be varied.

DESCRIPTION OF THE DRAWINGS

These and other features and advantages of the invention will be more readily understood by reason of the following detailed description when considered with the drawings, wherein.

DETAILED DESCRIPTION

An underreamer has a cylindrical tubular steel body 11. The upper end 12 of the underreamer is adapted for connection to a conventional drill string, preferably by means for a conventional threaded coupling (not shown). The opposite or lower end 13 preferably includes a conventional bit or bullnose (also not shown). It should be understood that the threaded coupling and the bit or bullnose do not form a part of this invention.

Figure 1:
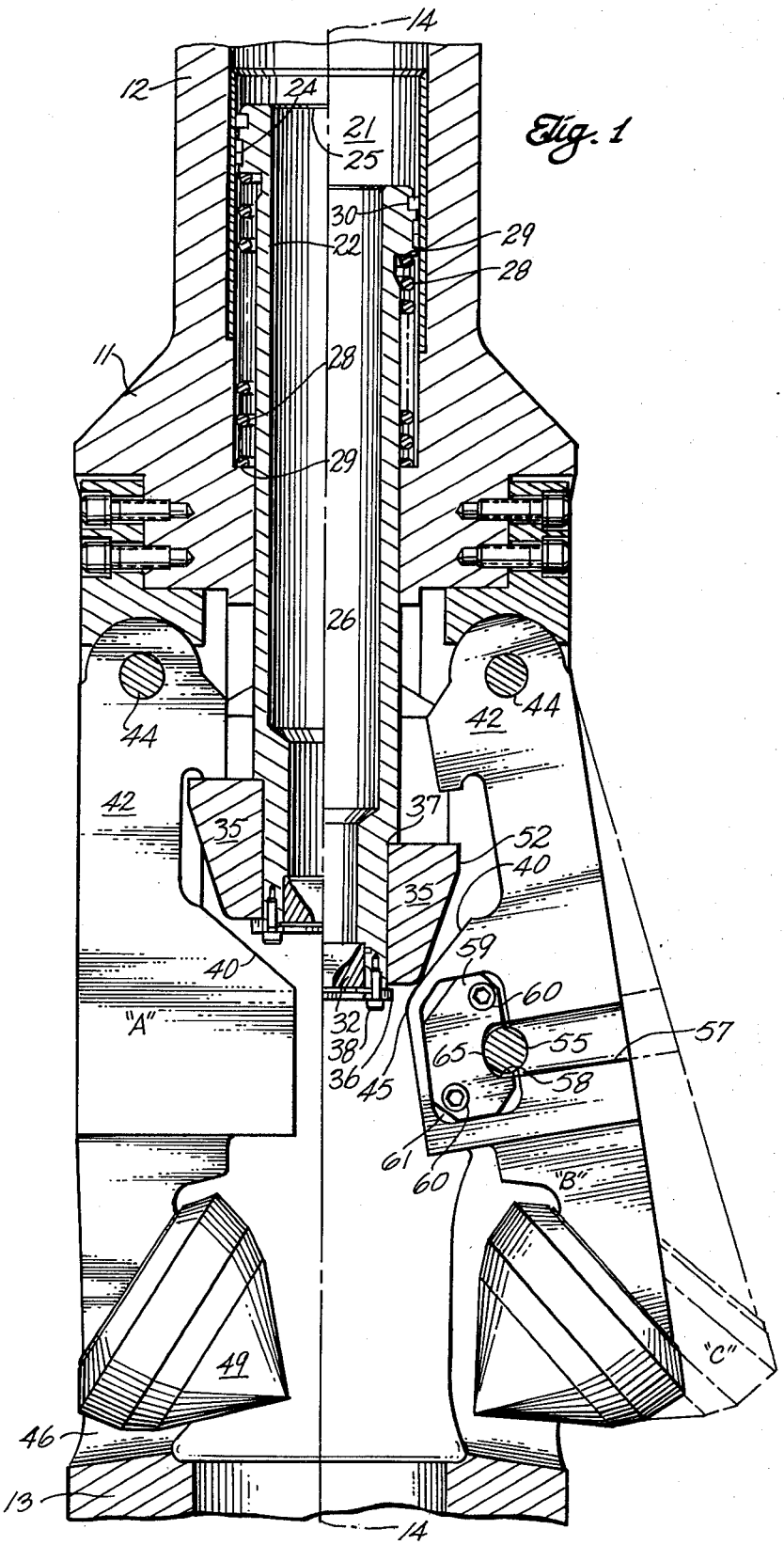
FIG. 1 is a longitudinal cross-section of an underreamer constructed according to this invention.

The underreamer has a central axis 14 about which rotation occurs during operation. FIG. 1 is divided into two portions on either side of axis 14. The left hand side of the drawing illustrates the underreamer with one of its cutting arms 42 in a fully retracted position "A", while the right hand portion of FIG. 1 illustrates the configuration of the underreamer with the cutting arm 42 in a fully deployed position "B". Other portions of the mechanism are in the positions they occupy when the arms are retracted (left half of the drawing) or deployed (right half of the drawing).

The internal volume of the underreamer includes a fluid chamber 21. A piston 22 is disposed in the lower end of the fluid chamber and is centered inside the underreamer by means of one or more wear rings 24. The piston head 25 is annular and permits communication of fluid from the chamber 21 into an axial bore 26 in the internal volume of the piston. The piston 22 is resiliently biased upwardly by a spring 28 which is set against a shoulder 29 where the interior bore of the underreamer body narrows. The shoulder sets a maximum downward movement of the piston head in operation. A seal 30 prevents leakage between the piston 22 and the fluid chamber 21, forcing the fluid to flow through the piston bore 26.

There is a cam 35 activated by the piston. The cam engages a cam follower surface 40 on each cutting arm 42. In the underreamer of FIG. 1, there are three cutting arms 42 evenly spaced 120° apart around the underreamer axis 14. The cam 35 is a unitary annular object which engages all three cutting arms. The cam is retained in place at the lower end of the piston by means of a cam retainer 36 and a shoulder 37 on the piston. A plurality of threaded fasteners 38 screwed into the piston end clamps the cam 35 between the retainer cam and the shoulder.

Each steel cutting arm is mounted in the underreamer by means of a hinge pin 44 and can move between a fully retracted position "A" substantially aligned with the body of the underreamer, shown in the left hand portion of FIG. 1, and a fully deployed position "B", with the arm extending outwardly from the underreamer body, shown in the right hand portion of FIG. 1.

To permit movement of the cutting arms in and out of the underreamer body, there is provided a recess 46 along the path of movement of each cutting arm.

Each cutting arm includes a generally conical shaped cutter 49. The cutter cones are indicated schematically in FIG. 1 without showing individual inserts or teeth which provide the cutting action on the formation as the underreamer is rotated. The cones form no part of this invention.

When it is time to lower the underreamer in the bore of a drill hole, the arms 42 are fully retracted as in position "A", and the underreamer is coupled to the bottom of a conventional drill string. The underreamer is lowered into the drill hole to the desired location, and drilling fluid is pumped into the fluid chamber 21 and against the piston head 25. Pressure drop for actuating the piston arises from the orifice in the nozzle cap 32. Hydraulic pressure forces the piston assembly down against the resiliency of the spring 28. Fluid flows through the annular piston head and the piston bore 26 through the nozzle opening.

The downward motion of the piston 22 forces the cam 35 downwardly to engage the cam follower surface 40 on each arm. This causes the cutting arms 42 to swing outwardly from the fully retracted position "A" toward the opened position "B". Initially the cutting surfaces on the cutter cone 49 engage rock formation adjacent the borehole and commence enlargement of the hole to permit full arm extension. Once the cutting arm has "started" itself in the rock formation, the process of arm extension occurs readily.

The outward extension of the arm is limited by a stop pin 55 fixed in the underreamer body which engages the effective bottom or end of an outwardly-opening slot 57 in the side of the cutting arm. The effective bottom of the slot is provided by a stop surface 58 recessed in a rectangular stop plate 59. The stop surface forms the end of the slot and engages the stop pin when the arm is in its opened position "B". The stop plate 59 is seated in a socket 61 in the side of the cutting arm which is contiguous with the slot. The stop plate is secured to the cutting arm by means of one or more threaded fasteners 60 received in countersunk holes 64 in the plate.

The camming surfaces on cam 35 and cam follower surface 40 are configured so that neither will become substantially parallel to the underreamer axis before the trailing edge 52 of the cam 35 has traveled to the bottom 45 of the cam follower surface. The arm is capable of extension outwardly past position "B" to an over-opened position "C", shown in dotted lines in FIG. 1. The maximum extent of outward travel by the arms is determined by the extent of camming action, and by the effective bottom or end of the slot which engages the stop pin 55. If the camming surfaces on the actuator and the arm were parallel, the arm would have a fixed extension or opened position and different arms would be required for each desired setting. With non-parallel surfaces at the opened position, the desired adjustability can be provided with an inexpensive set of interchangeable stop plates.

The length of outward travel of the cutting arm is established by fixing the effective bottom of the slot. The stop pin engages the stop surface carried on the stop plate, rather than the bottom 65 of the arm slot. Accordingly, the stop plate establishes the effective length of the slot 57 in the cutting arm, which fixes the maximum outward extension of the arm at the opened position. This in turn adjusts the opening diameter of the underreamer in operation.

Figure 2:
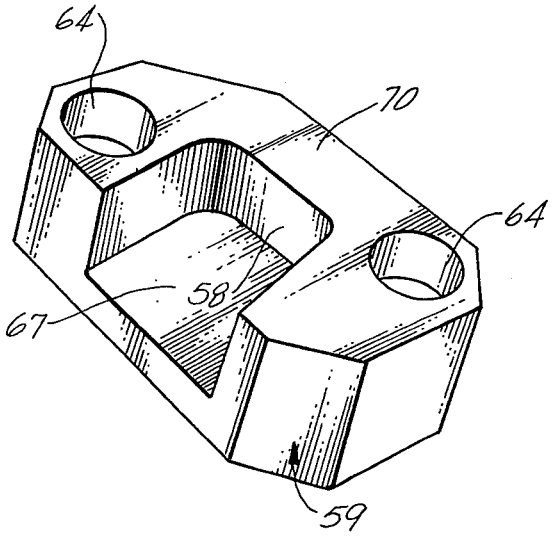
FIG. 2 is a perspective view of an insert for a cutting arm for the underreamer of FIG. 1.

The stop plate 59 is a replaceable insert which is removably fastened into the socket in the side of the cutting arm. An exemplary stop plate insert 59 is illustrated in FIG. 2 and has a rectangular shape with chamfered corners. The stop surface 58 is defined by a recess 67 in the stop plate.

A stop plate insert in an underreamer cutting arm is particularly advantageous because it provides a quick and simple method for changing the outward arm extension. The hinge pin 44 and the stop pin 55 are removed and the arm is lifted out of the underreamer. The stop plate is removed by unscrewing the fasteners 60, and a new stop plate having a different stop surface corresponding to the desired new arm extension is inserted in the socket 61 of the cutting arm, and fastened into the arm with the fasteners. This process is repeated for all cutting arms. The arms are remounted and the underreamer is ready for operation.

In effect the stop plate overlaps or masks a portion of the slot in which the stop pin fits. If no stop plate were in place in the socket, the effective length of the slot would be the wall of the socket. The stop plate overlaps that extent of travel and the stop surface decreases the effective length of the slot.

A set of stop plate inserts each having a stop surface of different configuration or depth can be provided as accessories for an underreamer. By interchanging such stop plate inserts on the cutting arm, the arm extension of the underreamer can be adjusted over a range of diameters, which increases the usefulness of the underreamer and the cutting arms. It is only necessary to provide inexpensive stop plate inserts to obtain a full range of adjustments. Previously the entire set of arms had to be replaced to change extension. The stop plates greatly reduce the cost of maintaining an inventory of different size underreamer arms.

When underreaming is completed, it is desirable to remove the underreamer from the drill hole. This is accomplished by raising the underreamer off the cutting face and controllably lowering the hydraulic pressure supplied to the underreamer so that the resiliency of the spring 28 overcomes the hydraulic pressure. The spring action forces the piston 22 upwardly. When the underreamer is lifted against the rock shoulder at the top of the underreamed section of the hole the cutting arms 42 are pressed back to the fully retracted position "A".

The underreamer may then be removed from the drill hole.

Workers skilled in the art to which this invention pertains will appreciate the description as set forth above pertains to the presently preferred best mode of the invention, from which other embodiments consistent with the spirit of the description may differ. For example, the underreamer has been described in the context of an embodiment which includes three cutting arms 42 which are equally spaced 120° apart about axis 14. It is evident, however, that an underreamer may have any number of cutting arms. In addition, the stop plate 59 has been described in the context of a block-shaped interchangeable insert having a recess which defines a stop surface. While the block shape of the stop plate is convenient for assuring good mechanical fit in a cutting arm socket, it will be appreciated that the stop plate may take the form of a simple bar of material which is strapped across the slot 57 of the cutting arm. Moreover, the stop plate may comprise an oblong block of material including an outwardly projecting tab extending into the slot and serving as a stop surface in place of an inwardly directed recess if it is desired to limit the range of extension of the cutting arm to a small increment outside the fully retracted position of the cutting arm. Accordingly, the description is not intended as an exhaustive catalog of all possible embodiments which this invention may take. Rather the description is intended as illustrative and exemplary, and the claims are presented in that spirit.

What is claimed is:

1. An underreamer comprising:

a tubular body;

means for connecting an upper end of the tubular body to a drill string;

at least one cutting arm hingedly connected to the body for movement between a retracted position essentially within the body and an opened position in which an arm outer end is disposed outwardly of the body;

a slot in a side of such an arm;

means for actuating the arm from the retracted position toward the opened position, the arm at the opened position being urged outwardly toward an over-opened position;

a stop pin mounted in the body having an end fitting into the slot in the arm; and a plate on the arm having a surface engageable with the stop pin at the opened position for limiting the maximum outward travel of the arm to the opened position, wherein said plate is removable from the arm for interchange with another such plate having a surface of different configuration from the first plate for changing the effective length of the slot.

2. An underreamer according to claim 1 wherein the actuating means comprises a cam engageable with a cam follower surface on the cutting arm.

3. An underreamer according to claim 2 wherein at least one of the cam and the cam follower surface when engaged with each other is substantially not parallel to the drill string axis.

4. An underreamer according to claim 1 wherein the arm comprises a socket and the plate is received in the socket in the arm.

5. An underreamer according to claim 1 wherein the surface on the plate is defined by an inwardly directed recess in the plate.

6. An underreamer comprising:

a tubular body;

means for connecting an upper end of the tubular body to a drill string;

at least one cutting arm hingedly connected to the body for movement between a retracted position essentially within the body and an opened position in which an arm outer end is disposed outwardly of the body;

a slot in a side of such an arm;

means for camming the arm between the retracted position and an over-opened position;

means for stopping the arm at the opened position between the retracted and over-opened positions comprising:

a stop pin in the body for cooperative engagement with the slot for limiting the maximum outward travel of the arm to the opened position; and a plate on the arm having a surface engageable with the stop pin, the surface overlapping at least part of the slot for establishing the effective length of the slot thereby to fix the maximum outward travel of the arm at the opened position, and wherein said plate is selectively removable from the arm for interchange with another such plate having a surface of different configuration from said plate for changing the effective length of the slot.

7. An underreamer according to claim 6 wherein the arm comprises a socket and the plate is received in the socket on the arm.

8. An underreamer according to claim 6 wherein the surface on the plate is defined by an outwardly opening recess in the plate.

9. A cutting arm for an underreamer comprising:

an inner end and an outer end, a cutting surface on the outer end, the inner end including means for hingedly connecting the arm to an underreamer body between a retracted position essentially within the body and an opened position where the arm outer end is disposed outwardly of the underreamer body;

urging means, in cooperative engagement with an actuating mechanism in the underreamer, for urging the arm from the retracted to the opened position in response to operation of the actuating mechanism;

an inwardly directed slot in a side of the arm for cooperatively engaging a fixed pin in the underreamer body to limit the outward extension of the arm at the opened position; and a socket in the side of the arm for receiving an insert for establishing an effective length for the slot, such insert including a surface for engaging the pin, such surface masking a portion of the slot for further limiting the outward extension of the arm at the opened position.

10. A cutting arm according to claim 9 wherein the urging means comprises a cam follower surface on the arm engageable with a cam operated by the actuating mechanism in the underreamer, at least one of the cam and the cam follower surface when engaged with each other being not parallel to a central longitudinal axis of the underreamer.

11. A cutting arm according to claim 9 wherein the socket is contiguous with the slot.

* * * * *